US011841188B2

(12) United States Patent
Ryu et al.

(10) Patent No.: US 11,841,188 B2
(45) Date of Patent: Dec. 12, 2023

(54) REFRIGERATOR APPLIANCE AND CANTILEVER TRACK WITH SENSOR

(71) Applicant: Haier US Appliance Solutions, Inc., Wilmington, DE (US)

(72) Inventors: Choon Jae Ryu, Prospect, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/671,812

(22) Filed: Feb. 15, 2022

(65) Prior Publication Data

US 2023/0258397 A1 Aug. 17, 2023

(51) Int. Cl.
*F25D 29/00* (2006.01)
*F25D 25/02* (2006.01)

(52) U.S. Cl.
CPC ..... *F25D 29/005* (2013.01); *F25D 25/02* (2013.01); *F25D 2400/36* (2013.01); *F25D 2700/06* (2013.01)

(58) Field of Classification Search
CPC ..... F25D 25/02; F25D 2400/361; F25D 2700/06; F25D 29/005; F25D 2500/06; F25D 2400/36; G01G 5/003; G01G 5/006; G01G 5/04; G01G 19/52; A47B 96/021; A47F 5/0043
See application file for complete search history.

(56) References Cited

U.S. PATENT DOCUMENTS

| | | | | |
|---|---|---|---|---|
| 3,689,909 | A * | 9/1972 | Cotter | F25D 25/02 200/85 R |
| 7,216,519 | B1 | 5/2007 | Ngo et al. | |
| 9,989,298 | B1 * | 6/2018 | Wantland | A47B 57/42 |
| 10,121,121 | B1 * | 11/2018 | De Bonet | A47B 57/34 |
| 10,466,095 | B1 | 11/2019 | O'Neill et al. | |
| 10,591,348 | B1 * | 3/2020 | Shi | A47F 3/0408 |
| 10,732,026 | B1 * | 8/2020 | Danenberg | H01R 13/514 |
| 10,746,589 | B1 * | 8/2020 | Danenberg | H05K 7/14 |
| 10,809,122 | B1 * | 10/2020 | Danenberg | A47F 5/103 |
| 11,017,350 | B1 | 5/2021 | De Bonet et al. | |
| 11,526,843 | B2 * | 12/2022 | Li | G06K 7/1413 |
| 11,561,125 | B1 * | 1/2023 | Gross | G01G 19/4144 |
| 2009/0255292 | A1 * | 10/2009 | Benz | A47B 57/06 700/275 |
| 2013/0242561 | A1 * | 9/2013 | Kramer | H01R 25/142 439/577 |
| 2013/0257253 | A1 * | 10/2013 | Haltmeyer | F25D 25/025 312/404 |

(Continued)

FOREIGN PATENT DOCUMENTS

| | | | |
|---|---|---|---|
| GB | 1267630 | A | 3/1972 |
| GB | 2307560 | A | 5/1997 |
| WO | WO2020111961 | A1 | 6/2020 |

*Primary Examiner* — Hiwot E Tefera
(74) *Attorney, Agent, or Firm* — Dority & Manning, P.A.

(57) ABSTRACT

An appliance including a cabinet forming a chamber. A track is attachable to the cabinet in the chamber. The track includes a pair of track arms at which a sensor is attached. A member extends between the pair of track arms, and an opening is formed at the member. A shelf includes a pair of support arms at which a frame is positionable. A mounting end of the support arms forms a tooth insertable into the opening at the track.

20 Claims, 6 Drawing Sheets

(56) References Cited

U.S. PATENT DOCUMENTS

| | | | | |
|---|---|---|---|---|
| 2014/0201042 | A1* | 7/2014 | Meyer | G06Q 10/087 705/28 |
| 2014/0224875 | A1* | 8/2014 | Slesinger | A47F 5/0043 439/38 |
| 2016/0048798 | A1* | 2/2016 | Meyer | G01G 19/42 705/28 |
| 2017/0249587 | A1* | 8/2017 | Jones | G06Q 10/087 |
| 2020/0072659 | A1* | 3/2020 | Bühlmeyer | G01G 19/42 |
| 2021/0030169 | A1* | 2/2021 | Zhai | A47F 5/0823 |
| 2022/0378196 | A1* | 12/2022 | González Gallegos | A47B 57/42 |

* cited by examiner

REFRIGERATOR APPLIANCE AND CANTILEVER TRACK WITH SENSOR

FIELD

The present subject matter relates generally to refrigerator appliances, and more particularly to refrigerator appliances having structures for supporting shelves.

BACKGROUND

Structures such as cantilever tracks are utilized to support refrigerator shelves. These structures may include sensors to determine weight of objects placed on the shelves. However, sensors, and placement of sensors onto such structures, is costly and may be bulky, which adversely affects the support structure.

As a result, further improvements in the field of support structures is desired. In particular, it would be advantageous to provide a cantilever track having improved sensor placement.

BRIEF DESCRIPTION

Aspects and advantages of the invention will be set forth in part in the following description, or may be obvious from the description, or may be learned through practice of the invention.

An aspect of the present disclosure is directed to an appliance including a cabinet forming a chamber. A track is attachable to the cabinet in the chamber. The track includes a pair of track arms at which a sensor is attached. A member extends between the pair of track arms, and an opening is formed at the member. A shelf includes a pair of support arms at which a frame is positionable. A mounting end of the support arms forms a tooth insertable into the opening at the track.

Another aspect of the present disclosure is directed to a refrigerator appliance including a cabinet forming a refrigerator chamber. A track is attached to the cabinet in the refrigerator chamber. The track includes a pair of track arms at which a sensor is attached. A member extends between the pair of track arms, and an opening is formed at the member. A shelf includes a pair of support arms at which a frame is positioned. A mounting end of the support arms forms a tooth insertable into the opening at the track.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
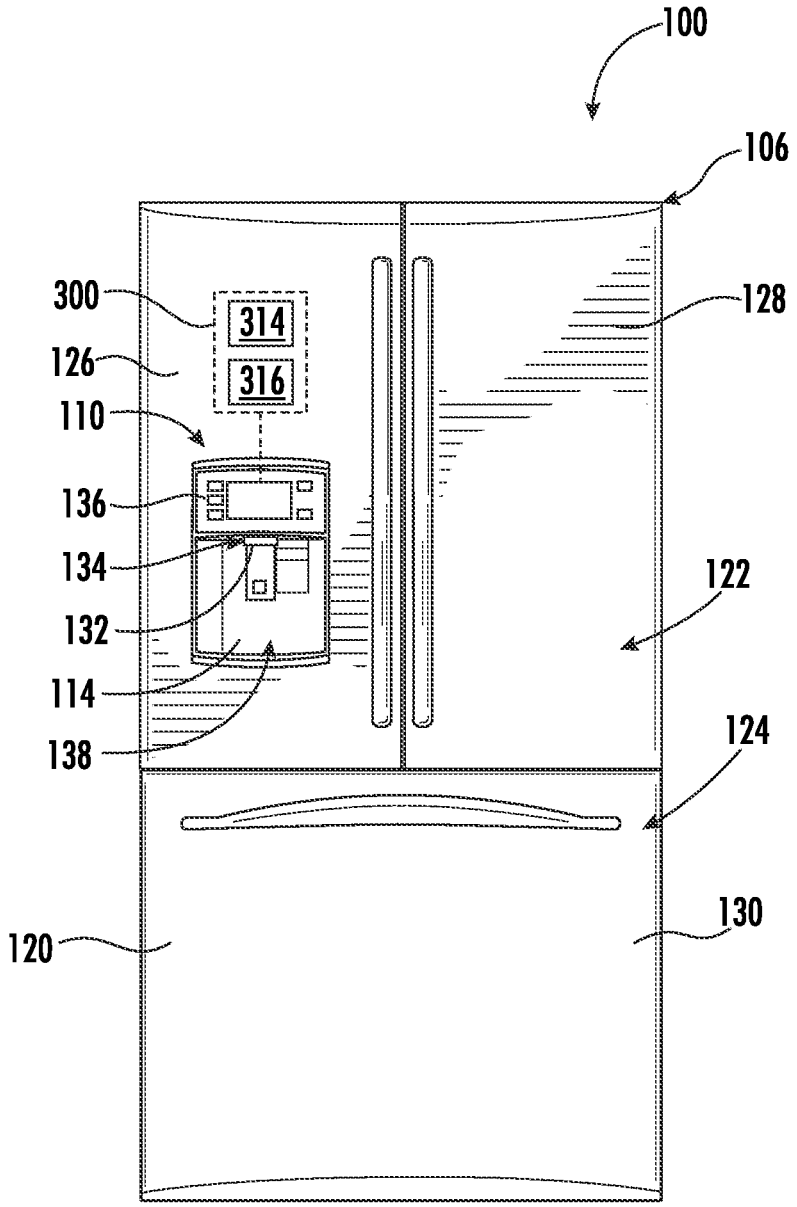
FIG. 1 provides a front, elevation view of an appliance in accordance with aspects of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Referring now to the figures, FIG. 1 depicts a front view of an example embodiment of an appliance 100. The appliance 100 may particularly form a refrigerator appliance. The appliance 100 may include a cabinet or housing 120 defining an upper refrigerator chamber 122 and a lower freezer chamber 124 arranged below the refrigerator chamber 122. As such, appliance 100 may generally be referred to as a bottom-mount refrigerator appliance. In the exemplary embodiment, housing 120 also defines a mechanical compartment (not shown) for receipt of a sealed cooling system. Using the teachings disclosed herein, one of skill in the art will understand that the present disclosure may be used with other types of refrigerator appliances (e.g., side-by-sides or top-mounts), freezer appliances, dishwashing appliances, clothes washing appliances, dryers, ovens or stoves, fluid dispensers generally, or other appropriate appliances. Accordingly, the description set forth herein is for illustrative purposes only and is not intended to limit the invention to any particular style or arrangement of appliance.

Refrigerator doors 126, 128 are rotatably hinged to an edge of housing 120 for accessing refrigerator chamber 122. A freezer door 130 is arranged below refrigerator doors 126, 128 for accessing freezer chamber 124. In the exemplary embodiment, freezer door 130 is coupled to a freezer drawer (not shown) slidably mounted within freezer chamber 124.

Appliance 100 may include a dispensing assembly 110 for dispensing liquid water and ice. Dispensing assembly 110 includes a dispenser 114 positioned on an exterior portion of appliance 100. Dispenser 114 includes a discharging outlet 134 for accessing ice and liquid water. A user interface panel 136 is provided for controlling the mode of operation of the dispenser 114, such as for providing water, ice, or a type of type (e.g., crushed, non-crushed, cubed, clear, etc.).

Discharging outlet 134 is an external part of dispenser 114, and is mounted in a dispensing recess or recessed portion 138 defined in an outside surface of refrigerator door 126. Recessed portion 138 is positioned at a predetermined elevation convenient for a user to access ice or liquid water and enabling the user to access ice or liquid water without the need to bend-over and without the need to access freezer chamber 124. In the exemplary embodiment, recessed portion 138 is positioned at a level that approximates the chest level of a user. However, in other embodiments, the dispensing assembly 110 may be positioned within the appliance 100, such as within a chilled chamber thereof.

Operation of the appliance 100 is regulated by a control device or controller 300 that is operatively coupled to user interface panel 136, sensor 230, or both. The controller 300 may include one or more processors 314 and one or more memory devices 316. The one or more memory devices 316 may be configured to store instructions that, when executed by the one or more processors 314, causes the appliance 100 to perform operations such as provided below. The memory device(s) 316 may be configured to data corresponding to one or more signals, functions, charts, tables, schedules, or determined values such as provided herein.

Panel 136 provides selections for user manipulation of the operation of appliance 100 such as e.g., selections between whole or crushed ice, chilled liquid water, or other options. In response to user manipulation of the user interface panel 136, the controller 300 operates various components of the appliance 100. The controller 300 may be positioned in a variety of locations throughout appliance 100. In the illustrated embodiment shown in FIG. 1, the controller 300 is located within or beneath the user interface panel 136 on door 126. In such an embodiment, input/output ("I/O") signals may be routed between controller 300 and various operational components of appliance 100. In one exemplary embodiment, the user interface panel 136 may represent a general purpose I/O ("GPIO") device or functional block. In another exemplary embodiment, the user interface 136 may include input components, such as one or more of a variety of electrical, mechanical or electro-mechanical input devices including rotary dials, push buttons, and touch pads. The user interface 136 may be in communication with the controller 300 via one or more signal lines or shared communication busses, such as described further herein.

Figure 2:
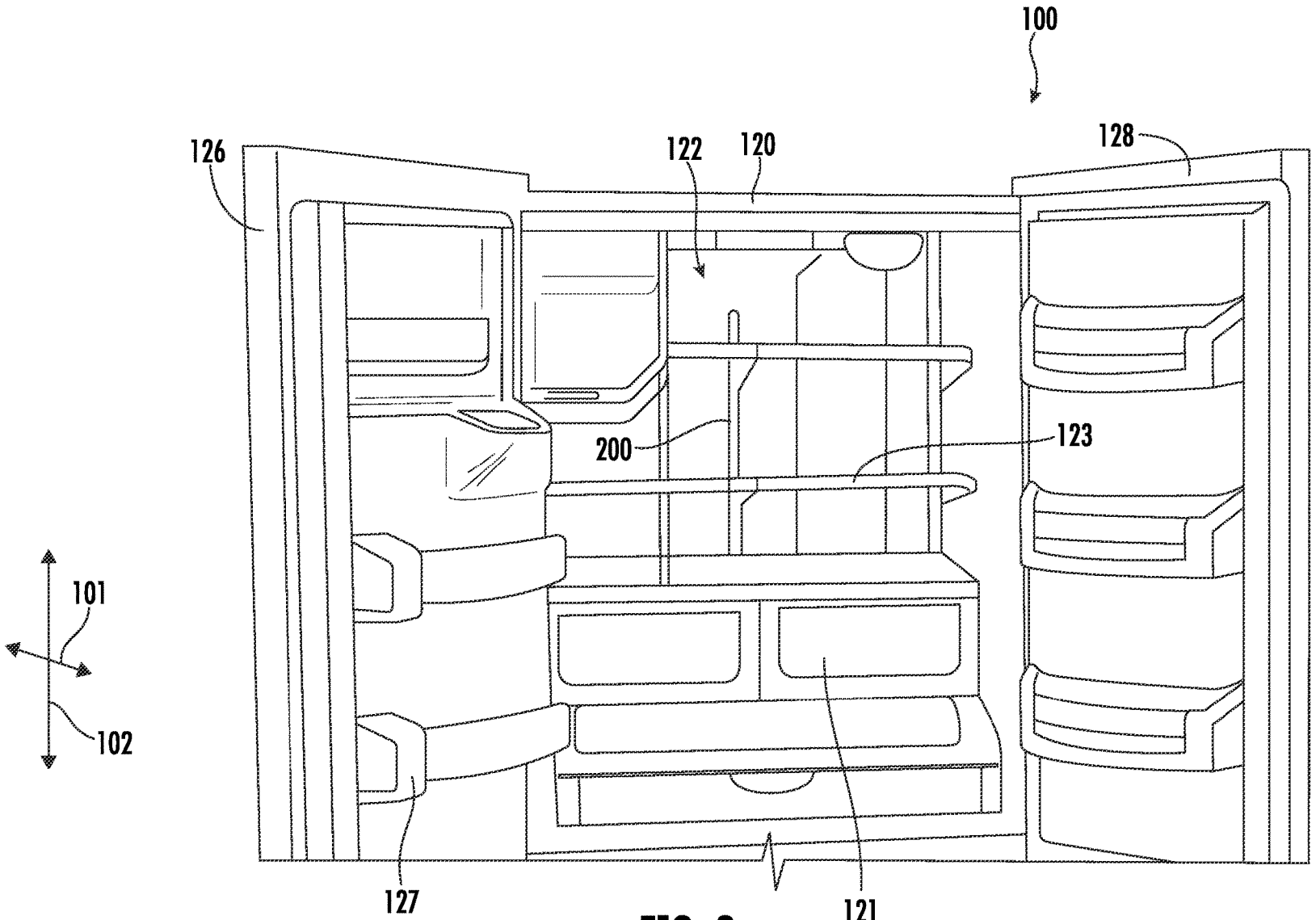
FIG. 2 provides a perspective view of an embodiment of an interior of the appliance of FIG. 1 in accordance with aspects of the present disclosure.
Figure 3:
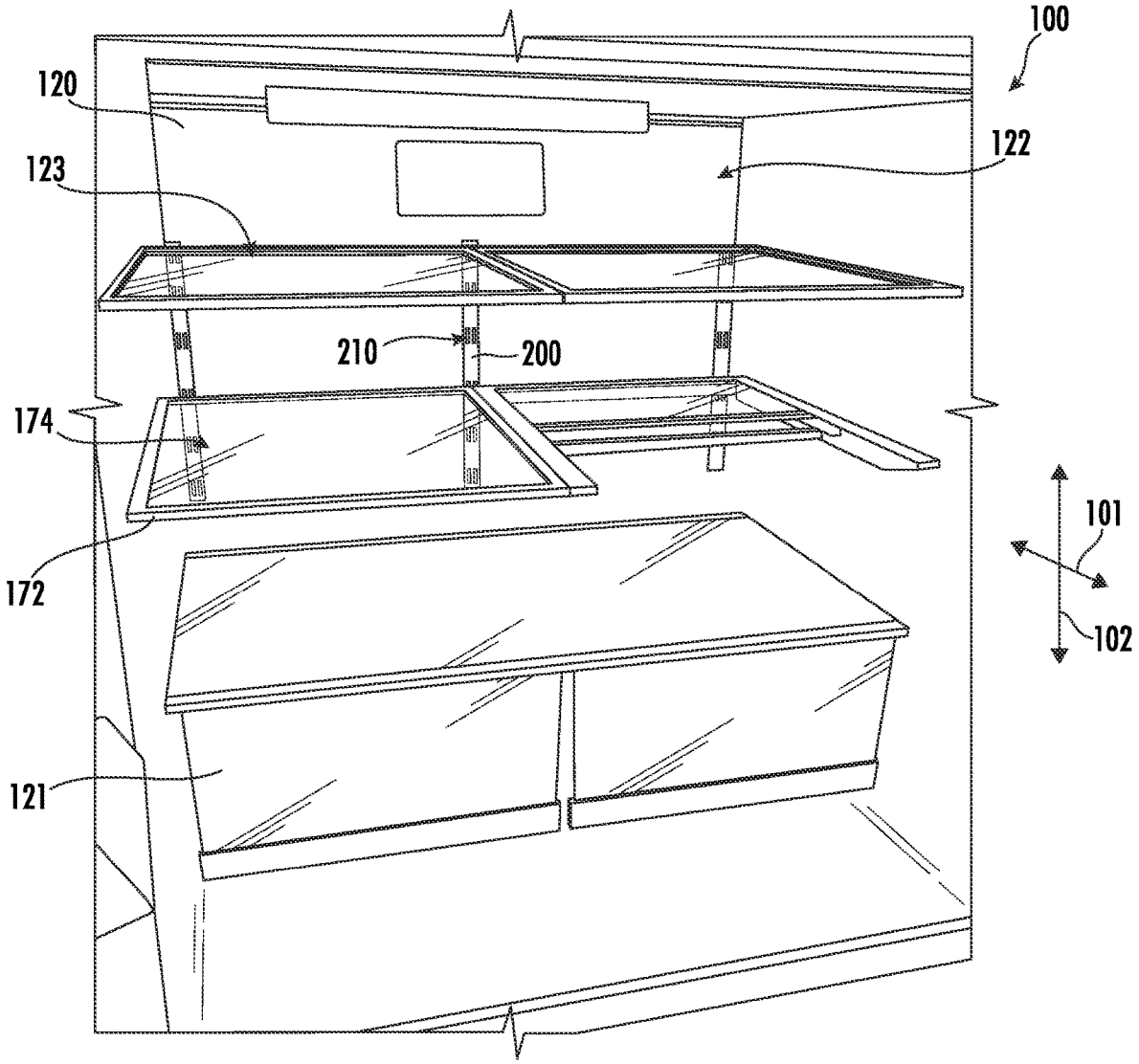
FIG. 3 provides a perspective view of an embodiment of an interior of the appliance of FIG. 1 in accordance with aspects of the present disclosure.

Referring now to FIGS. 2-3, perspective views of an exemplary embodiment of the appliance 100 with doors 126, 128 open is provided, providing a view of an exemplary embodiment of an interior or refrigerator chamber 122. A reference first axis 101 defines a direction into and out of the refrigerator chamber 122. A reference second axis 102 defines a vertical direction. The refrigerator chamber 122 includes a plurality of shelves and drawers positioned within the refrigerator chamber 122. Shelves may include door-mounted shelves 127 positioned at one or both of doors 126, 128 and rack-mounted shelves 123 retained by an interior portion of the housing 120. Drawers 121 may be in sliding configuration and positioned below or between shelves 123, such as along the first axis 101. A cantilever track 200 is positioned in the housing 120 to retain one or more of the shelves 123, such as described further below.

Figure 4:
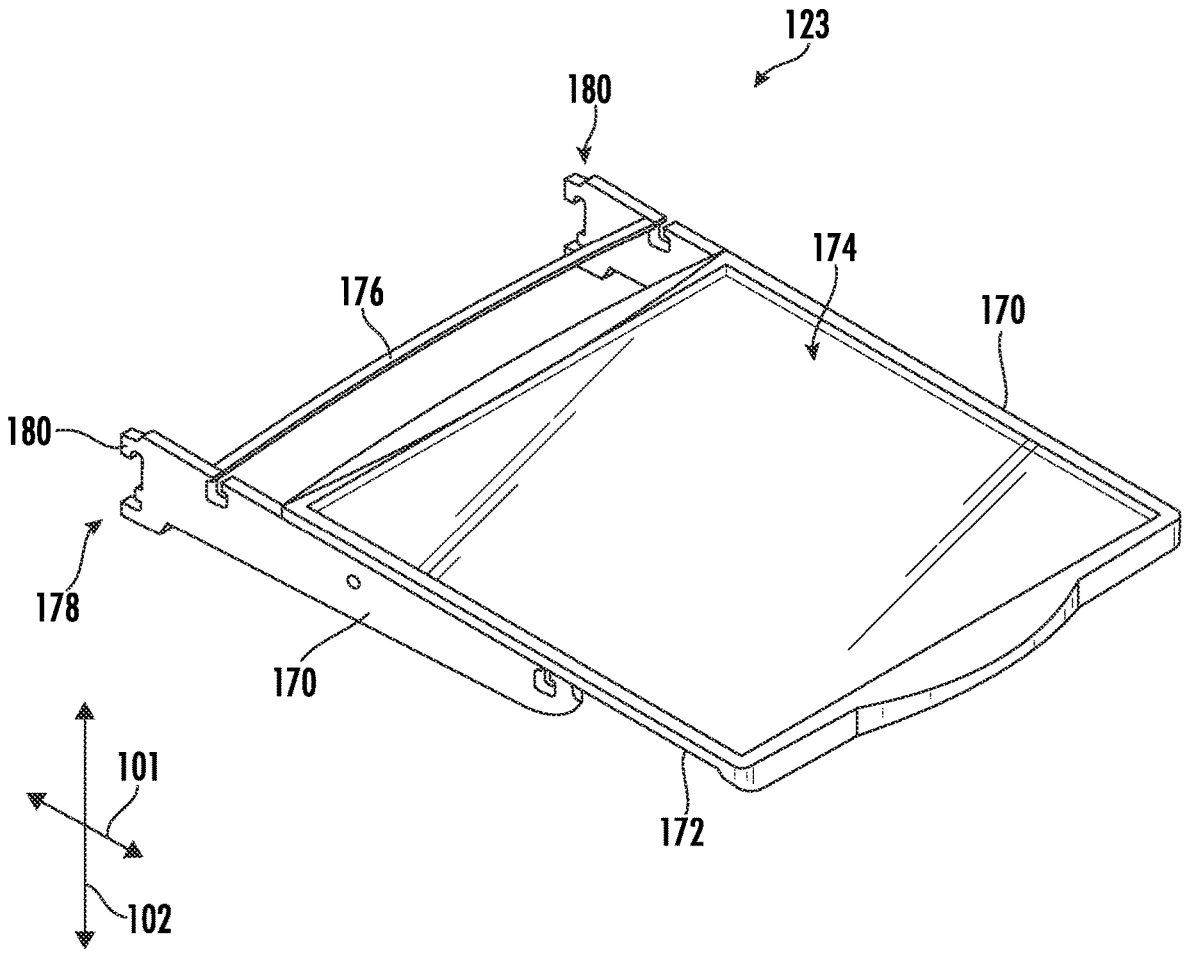
FIG. 4 provides a perspective view of a shelf of the appliance in accordance with aspects of the present disclosure.
Figures 5, 6:
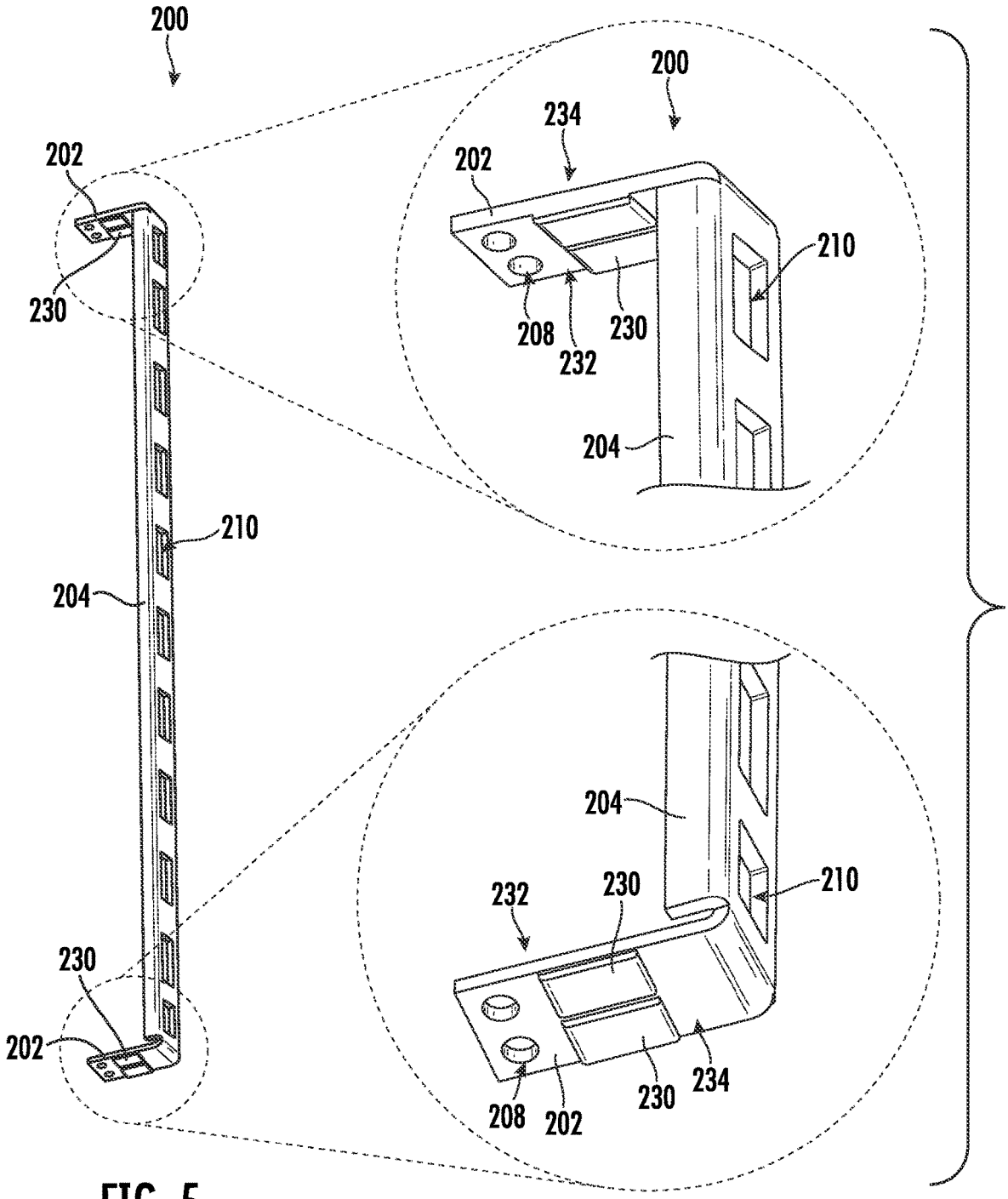
FIG. 5 provides a perspective view of an exemplary embodiment of a cantilever rack of the appliance in accordance with aspects of the present disclosure.
FIG. 6 provides a close-up perspective view of an exemplary embodiment of portions of the cantilever rack of FIG. 5 in accordance with aspects of the present disclosure.
Figure 7:
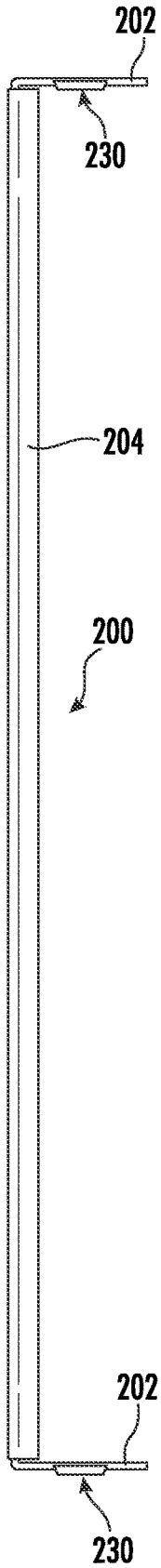
FIG. 7 provides a side view of an exemplary embodiment of the cantilever rack of FIG. 5 in accordance with aspects of the present disclosure.
Figure 8:
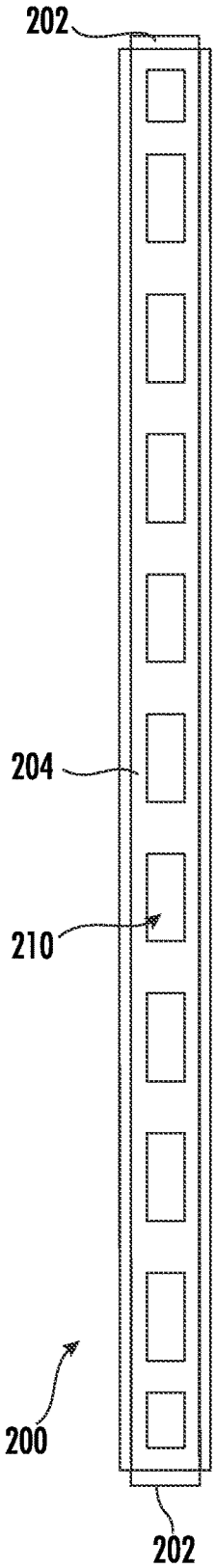
FIG. 8 provides a side view of an exemplary embodiment of the cantilever rack of FIG. 7 in accordance with aspects of the present disclosure.
Figure 9:
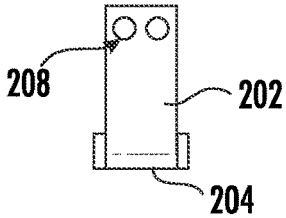
FIG. 9 provides a side view of an exemplary embodiment of the cantilever rack of FIGS. 7-8 in accordance with aspects of the present disclosure.

Referring to FIG. 4, a perspective view of an exemplary embodiment of a rack-mounted shelf 123 is provided. The shelf 123 includes a pair of support arms 170 at which a shelf frame 172 is positionable. The shelf frame 172 may form a rectangular frame at which a shelf surface 174 is positionable. The shelf surface 174 may include glass, plastic, or other appropriate material at which items may be placed onto the surface 174. The frame 172 forms a perimeter that holds the surface 174. The pair of support arms 170 is configured to hold the frame 172. In certain embodiments, the support arms 170 form tracks, grooves, or other features allowing for the frame 172 to slide onto the support arms 170. In other embodiments, the support arms 170 form walls, tracks, or other features configured to allow the frame 172 to rest in place at the support arms 170. The shelf 123 may include a cross member 176 extending between and coupled to the pair of support arms 170. A mounting end 178 of the support arm 170 forms a tooth 180 or other member configured to be received at an opening 210 at the track 200, such as depicted in further detail at FIGS. 5-9. The tooth 180 is insertable into the opening 210, such as insertable along the first axis 101, to allow for the shelf 123 to be cantilevered from the track 200.

Referring now to FIGS. 5-9, views of an exemplary embodiment of a cantilever track 200 are provided. The track 200 includes a pair of track arms 202 at which a sensor 230 is attached. The sensor 230 may particularly form a strain gage or load sensor configured to determine a load placed at the shelf 123 when the shelf 123 is attached to the track 200. Sensor 230 may be bonded into or onto the arm 202 using an adhesive or other appropriate bonding method. The shelf 123 is attachable to the track 200 through the opening 210 formed at a longitudinal member 204 extending between the pair of track arms 202. The member 204 may particularly form a plurality of openings 210 in adjacent arrangement along the longitudinal extension of the member 204 between the pair of track arms 202. The sensor 230 may be positioned at an inside face 232 of the arm 202 (i.e., between the pair of track arms 202). Additionally, or alternatively, the sensor 230 may be positioned at an outside face 234 of the arm 202.

The tooth 180 at the shelf 123 is insertable into a respective opening 210 at the track 200. The track 200 may include a fastener interface 208 configured to attach the track 200 to the housing 120 (FIGS. 2-3). The fastener interface 208 may include a hole through which a mechanical fastener (not depicted) is extendable through the arm 202 and into the housing 120. The mechanical fastener may include a threaded fastener, such as, but not limited to, a screw, a bolt, a tie rod, or other appropriate fastening device. However, it should be appreciated that other appropriate fastening methods may be utilized.

Referring back to FIGS. 2-3, the refrigerator appliance 100 may include a plurality of tracks 200 spaced apart from one another, such as spaced corresponding to a spacing of the pair of support arms 170 of the shelf 123. In one embodiment, the plurality of tracks 200 is spaced apart along a third axis orthogonal to the first axis 101 and the second axis 102. In another embodiment, the plurality of tracks 200 is spaced apart along the second axis 102. In various embodiments, sensor 230 is communicatively coupled to controller 300 (FIG. 1), such as via wired or wireless communication to controller 300 of stress, strain, or load experienced at the shelf 123.

Controller 300 may include a memory device(e.g., non-transitive storage media) and microprocessor, such as a general or special purpose microprocessor operable to execute programming instructions or micro-control code associated with a cleaning cycle. The memory device may represent random access memory such as DRAM, or read only memory such as ROM or FLASH. In one embodiment, the processor executes programming instructions stored in memory. The memory device may be a separate component from the processor or may be included onboard within the processor. Alternatively, controller 300 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Sensor 230 may be in communication with controller 300 via one or more signal lines or shared communication busses. User interface panel 136 may be in communication (e.g., wired or wireless communication) with controller 300 via one or more suitable shared networks.

It should be appreciated that communications busses and secondary devices may correspond to any device that may be programmed to communicate controller 300 using one of Wi-Fi, Bluetooth®, ZigBee®, or similar type of wireless communications technologies and networks while running a program that provides for user input. In this context, devices such as, but not limited to, smartphones, tablet devices, and standalone devices may be used to implement the present subject matter.

Embodiments of the appliance 100 provided herein including embodiments of the track 200 such as depicted and described herein allow for improved weight or load measurement, such as by allowing for multiple sensors 230 at the track 200. Each sensor 230 may include a plurality of strain gages configured to determine load or weight placed onto the shelf 123 attached to the track 200. Controller 300 may store a lookup table, chart, graph, schedule, or other data that may correlate data, such as strain values or displacement of the shelf 123, from sensor 230 and correlate to weight or load at the shelf 123. Controller 300 may be configured to receive data or measurement signals from sensor 230, and further generate output signals to the user interface panel 136. The output signal may include signals, messages, or audio or visual signals indicative of weight at the shelf 123, such as signals configured to communicate to a user the weight at the shelf 123 or a condition at the shelf 123. For instance, the condition may include an overload condition, an empty/full status based on a change in weight, or other desired indication of contents on shelf 123 based on load at the shelf 123, or changes in load over time.

Further aspects of the invention are provided by one or more of the following embodiments:

1. An appliance including a cabinet forming a chamber; a track attachable to the cabinet in the chamber, the track including a pair of track arms at which a sensor is attached, wherein a member extends between the pair of track arms, and wherein an opening is formed at the member; and a shelf including a pair of support arms at which a frame is positionable, wherein a mounting end of the support arms forms a tooth insertable into the opening at the track.

2. The appliance of any one or more clauses herein, wherein the opening at the track includes a plurality of openings in adjacent arrangement along a longitudinal extension of the member between the pair of track arms.

3. The appliance of any one or more clauses herein, wherein the sensor is a strain gage or load sensor.

4. The appliance of any one or more clauses herein, wherein the sensor is positioned at an inside face of the track arm.

5. The appliance of any one or more clauses herein, wherein the sensor is positioned at an outside face of the track arm.

6. The appliance of any one or more clauses herein, wherein the track comprises a plurality of tracks spaced apart from one another.

7. The appliance of any one or more clauses herein, wherein the plurality of tracks is spaced apart from one another corresponding to spacing of the pair of support arms at the shelf.

8. The appliance of any one or more clauses herein, including a controller communicatively coupled to the sensor at the track, wherein the controller is configured to receive data from the sensor.

9. The appliance of any one or more clauses herein, including a user interface panel operatively coupled to the controller, wherein the user interface panel is configured to receive signals from the controller.

10. The appliance of any one or more clauses herein, wherein the signals include a message, an audio signal, or a visual signal indicative of weight at the shelf.

11. The appliance of any one or more clauses herein, wherein the track is a cantilever track, and wherein the tooth at the shelf is configured to be received through the opening at the track, the shelf configured to be cantilevered from the track.

12. A refrigerator appliance, including a cabinet forming a refrigerator chamber; a track attached to the cabinet in the refrigerator chamber, the track including a pair of track arms at which a sensor is attached, wherein a member extends between the pair of track arms, and wherein an opening is formed at the member; and a shelf including a pair of support arms at which a frame is positioned, wherein a mounting end of the support arms forms a tooth insertable into the opening at the track.

13. The refrigerator appliance of any one or more clauses herein, wherein the track is a cantilever track, and wherein the tooth at the shelf is configured to be received through the opening at the track, the shelf configured to be cantilevered from the track.

14. The refrigerator appliance of any one or more clauses herein, wherein the opening at the track includes a plurality of openings in adjacent arrangement along a longitudinal extension of the member between the pair of track arms.

15. The refrigerator appliance of any one or more clauses herein, wherein the track includes a plurality of tracks spaced apart from one another.

16. The refrigerator appliance of any one or more clauses herein, wherein the plurality of tracks is spaced apart from one another corresponding to spacing of the pair of support arms at the shelf.

17. The refrigerator appliance of any one or more clauses herein, wherein the sensor is positioned at an inside face of the track arm.

18. The refrigerator appliance of any one or more clauses herein, wherein the sensor is positioned at an outside face of the track arm.

19. The refrigerator appliance of any one or more clauses herein, including a controller communicatively coupled to the sensor at the track, wherein the controller is configured to receive data from the sensor; and a user interface panel operatively coupled to the controller, wherein the user interface panel is configured to receive signals from the controller.

20. The refrigerator appliance of any one or more clauses herein, wherein the signals include a message, an audio signal, or a visual signal indicative of weight at the shelf.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

a cabinet forming a chamber;

a track attachable to the cabinet in the chamber, the track comprising a member from which a pair of track arms extends to attach to the track to the cabinet, wherein a sensor is attached to the pair of track arms, wherein the member extends between the pair of track arms, and wherein an opening is formed at the member; and a shelf comprising a pair of support arms at which a frame is positionable, wherein a mounting end of the support arms forms a tooth insertable into the opening at the member of the track.

2. The appliance of claim 1, wherein the opening at the track comprises a plurality of openings in adjacent arrangement along a longitudinal extension of the member between the pair of track arms.

3. The appliance of claim 1, wherein the sensor is a strain gage or load sensor.

4. The appliance of claim 1, wherein the sensor is positioned at an inside face, an outside face, or both, of the track arm.

5. The appliance of claim 1, wherein the track comprises a plurality of tracks spaced apart from one another.

6. The appliance of claim 5, wherein the plurality of tracks is spaced apart from one another corresponding to spacing of the pair of support arms at the shelf.

7. The appliance of claim 1, comprising:

a controller communicatively coupled to the sensor at the track, wherein the controller is configured to receive data from the sensor.

8. The appliance of claim 7, comprising:

a user interface panel operatively coupled to the controller, wherein the user interface panel is configured to receive signals from the controller.

9. The appliance of claim 8, wherein the signals comprise a message, an audio signal, or a visual signal indicative of weight at the shelf.

10. The appliance of claim 1, wherein the track is a cantilever track, and wherein the tooth at the shelf is configured to be received through the opening at the track, the shelf configured to be cantilevered from the track.

11. The appliance of claim 1, wherein the pair of track arms comprises a fastener interface configured to attach the track to the cabinet.

12. A refrigerator appliance, comprising:

a cabinet forming a refrigerator chamber;

a track attachable to the cabinet in the chamber, the track comprising a member from which a pair of track arms extends to attach to the cabinet to mount the track, wherein a sensor is attached to the pair of track arms, wherein the member extends between the pair of track arms, and wherein an opening is formed at the member; and a shelf comprising a pair of support arms at which a frame is positionable, wherein a mounting end of the support arms forms a tooth insertable into the opening at the member of at the track.

13. The refrigerator appliance of claim 12, wherein the track is a cantilever track, and wherein the tooth at the shelf is configured to be received through the opening at the track, the shelf configured to be cantilevered from the track.

14. The refrigerator appliance of claim 12, wherein the opening at the track comprises a plurality of openings in adjacent arrangement along a longitudinal extension of the member between the pair of track arms.

15. The refrigerator appliance of claim 12, wherein the track comprises a plurality of tracks spaced apart from one another.

16. The refrigerator appliance of claim 15, wherein the plurality of tracks is spaced apart from one another corresponding to spacing of the pair of support arms at the shelf.

17. The refrigerator appliance of claim 12, wherein the sensor is positioned at an inside face, an outside face, or both, of the track arm.

18. The refrigerator appliance of claim 12, comprising:

a controller communicatively coupled to the sensor at the track, wherein the controller is configured to receive data from the sensor; and a user interface panel operatively coupled to the controller, wherein the user interface panel is configured to receive signals from the controller.

19. The refrigerator appliance of claim 18, wherein the signals comprise a message, an audio signal, or a visual signal indicative of weight at the shelf.

20. The refrigerator appliance of claim 12, wherein the pair of track arms comprises a fastener interface configured to attach the track to the cabinet.

* * * * *